US008402955B2

(12) United States Patent
Tulpa

(10) Patent No.: US 8,402,955 B2
(45) Date of Patent: Mar. 26, 2013

(54) BOW PRESS

(76) Inventor: Kevin R. Tulpa, Elk Rapids, MI (US)

( * ) Notice: Subject to any disclaimer, the term of this patent is extended or adjusted under 35 U.S.C. 154(b) by 585 days.

(21) Appl. No.: 12/652,484

(22) Filed: Jan. 5, 2010

(65) Prior Publication Data

US 2011/0162631 A1 Jul. 7, 2011

(51) Int. Cl.
*F41B 5/14* (2006.01)
*F41B 5/00* (2006.01)

(52) U.S. Cl. ..... 124/1; 124/80; 124/86; 124/88

(58) Field of Classification Search ..... 124/1, 80, 124/86, 88
See application file for complete search history.

(56) References Cited

U.S. PATENT DOCUMENTS

| | | | | |
|---|---|---|---|---|
| 3,055,655 | A * | 9/1962 | Chelf | 29/235 |
| 5,222,473 | A * | 6/1993 | Lint | 124/86 |
| 5,370,103 | A * | 12/1994 | Desselle | 124/86 |
| 5,433,186 | A * | 7/1995 | Corwin | 124/86 |
| 5,435,523 | A | 7/1995 | Hying et al. | |
| 6,386,190 | B1 * | 5/2002 | Kurtz, Jr. | 124/1 |
| 6,926,261 | B1 | 8/2005 | Renshaw | |
| 6,932,070 | B1 * | 8/2005 | Kurtz, Jr. | 124/1 |
| 6,968,834 | B1 * | 11/2005 | Gibbs | 124/1 |
| 7,185,644 | B2 * | 3/2007 | Kurtz, Jr. | 124/1 |
| 7,255,099 | B2 * | 8/2007 | Henry | 124/1 |
| 7,311,095 | B2 * | 12/2007 | Bauder et al. | 124/1 |
| 7,597,094 | B2 * | 10/2009 | Pittman | 124/1 |
| 7,644,708 | B2 * | 1/2010 | Pittman | 124/1 |
| 2007/0119438 | A1 * | 5/2007 | Pittman | 124/1 |
| 2009/0056688 | A1 * | 3/2009 | Marsh et al. | 124/1 |
| 2010/0089376 | A1 * | 4/2010 | Bunk et al. | 124/86 |
| 2011/0232616 | A1 * | 9/2011 | Gouramanis | 124/1 |

OTHER PUBLICATIONS

C.W. Erickson MFG, LLC, ArcherHunter Big Squeeze Bow Press, webpage, 2006, five pages (2 archived pages for date, 3 current pages), www.archerhunter.com, U.S.

* cited by examiner

*Primary Examiner* — Gene Kim
*Assistant Examiner* — Alexander Niconovich
(74) *Attorney, Agent, or Firm* — Northern Michigan Patent Law, PLC

(57) ABSTRACT

A bow press for pressing the limbs of compound bows. The press has a pair of coplanar lever arms mounted on a frame. The lever arms are spaced inwardly from their fixed fulcrum points on the frame toward a bow-pressing location defined between their upper ends, such that their path of travel from a starting position is primarily on the downward arcuate path of their range of motion. The starting contact point with the bow's limbs can thus be closer to the bow's cams, reducing the adjustment skill needed to position the bow, and reducing stress on the limbs. In a preferred form, the lever arms are simultaneously operated by a central telescopic screw jack mounted on the frame to reciprocate on an axis perpendicular to the bow held between the lever arms.

15 Claims, 8 Drawing Sheets

BOW PRESS

RELATED APPLICATIONS/PRIORITY BENEFIT CLAIM

None.

FIELD

The subject matter of the present application is in the field of compound archery bow presses.

BACKGROUND

Compound archery bows have very stiff limbs that flex significantly less than those on traditional or recurve bows. Compound bows rely on cable tension between wheels or "cams" on the ends of the limbs to flex the limbs a small amount during actual use. Servicing the compound bow, however, requires the limbs to be flexed more than in actual use, in order to relax the bow sufficiently to release the cable tension.

Specialized presses have accordingly been developed for flexing the stiff limbs of compound archery bows for servicing the strings, cables, cams, and other components. Examples of compound bow presses include those shown in U.S. Pat. Nos. 6,386,190 to Kurtz, Jr. (fixed limb-supporting rollers with a vertically movable riser-engaging bar located between the bowstring/cable and the riser); 6,968,834 to Gibbs (a first limb support at the riser/limb intersection and a second limb support farther out on the limb to bend the bow in a manner closely approximating the manner in which it is stressed during actual use); 7,185,644 to Kurtz, Jr. (similar to the Kurtz, Jr. '190 patent above, but with a pivoting roller on one spacer bar powered by a hydraulic jack to supplement the vertical riser jack for pressing parallel limb bows); and 7,597,094 to Pittman (linear translating limb-pressing members engaging only the ends of the limbs from outside the curvature of the bow).

The foregoing bow presses are believed to have one or more disadvantages, including being limited to pressing a single style of bow, or needing relatively complicated adjustments when pressing different styles or sizes of bows; lack of planar stability; a tendency to stress the bows' limbs more than necessary; and/or relatively weak drive mechanisms unsuitable for use with shorter and stiffer bow limbs.

BRIEF SUMMARY

I have invented a compound bow press that eliminates the foregoing disadvantages found in prior bow presses. My bow press includes a frame and a pair of coplanar lever arms mounted on the frame to define a bow-receiving location therebetween, with a first bow press axis defined between the upper limb-pressing ends of the lever arms, and a second bow press axis defined orthogonally to the first bow press axis through a center of the bow-pressing location. Each of the lever arms comprises an upper limb-pressing end adapted to engage a limb of a bow (either directly or through a bow limb contact device), and a lower drive end. Each of the lever arms is mounted for rotational movement on a fixed fulcrum point on the frame, the fulcrum point operatively connected to the lever arm between the upper limb-pressing end and the lower drive end. A drive is operatively connected to the lower drive ends to rotate the limb-pressing ends of the lever arms on the fixed fulcrum points toward and away from the bow-receiving location. Each lever arm is spaced inwardly toward the bow-receiving location from its fixed fulcrum point by a fulcrum-extending arm rotatably connected to the fixed fulcrum point, the fixed fulcrum point located outside a primary convex curvature of a bow in the bow-pressing location, and below the limb-pressing end of the associated lever arm.

In a further form, the drive is operatively connected to each lower drive end with a pivot connection. The drive may comprise a reciprocating member movable toward and away from the bow-receiving location in a direction perpendicular to the first bow press axis (on the second bow press axis), and in a preferred form is a powerful screw jack pivotally coupled to the lower drive ends of the lever arms via a transverse pulling bar and a pair of pivot arms spaced on opposing sides of the screw jack.

In a further form, multiple bow contact devices can be removably secured to the upper limb-pressing ends of the lever arm to adapt the arms to different types of bow limbs or to provide different types of bow limb contact for the pressing operation.

The apparatus functions by placing a bow with the exterior surfaces of its limbs in contact with the limb-pressing ends in the bow-receiving location between the lever arms, and then operating the drive mechanism to rotate the limb-pressing ends of the lever arms inwardly toward the bow-receiving location to flex or press the limbs at a location near the limb ends. The outwardly- and downwardly-extended fulcrum points result in the limb-pressing ends (and any contact device secured thereto) moving at an increased rate of downwardly arcuate travel, to reduce or eliminate travel toward the cams on the outer ends of the limbs.

These and other features and advantages of the invention will become apparent from the detailed description below, in light of the accompanying drawings.

DETAILED DESCRIPTION

Figure 1:
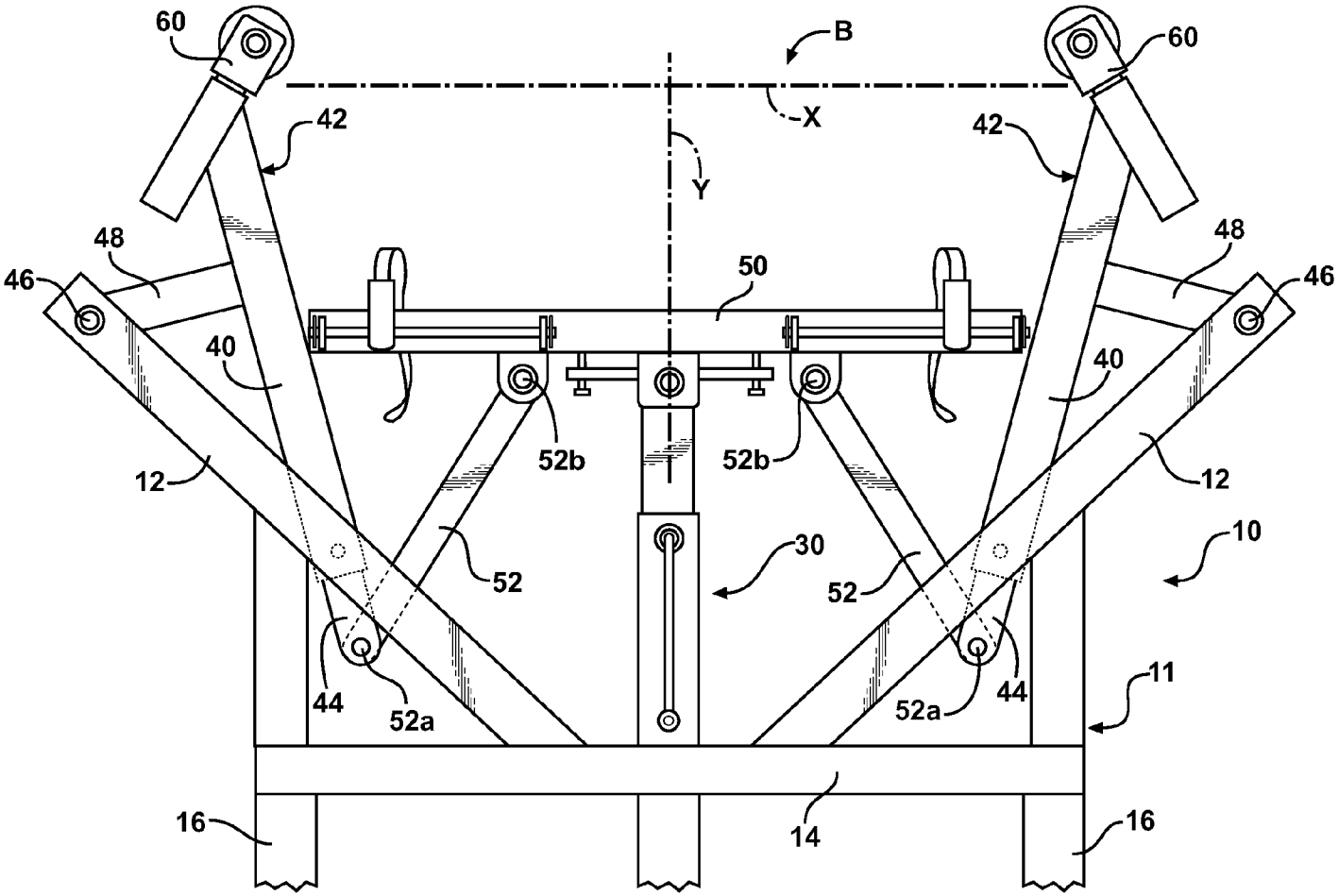
FIG. 1 is a front elevation view of a bow press according to an illustrative embodiment of the present invention.

Referring first to FIG. 1, a bow press 10 is shown in exemplary form in order to teach how to make and use the claimed invention. Bow press 10 has a frame 11 including, in the illustrated example, a pair of coplanar lever support bars 12 arranged in a V-shape, secured to crossbars 14 (hereafter "crossbar", since the illustrated split structure is preferred but optional), and supported by legs 16. Crossbar 14 and legs 16 are raised off the ground (or other support surface). Although the illustrated example is intended to represent a portable frame self-supported on its own legs 16, the frame need not be portable or self-supporting, but for example may be secured to or built into another support such as a table, workbench, wall, or floor.

Figure 1A:
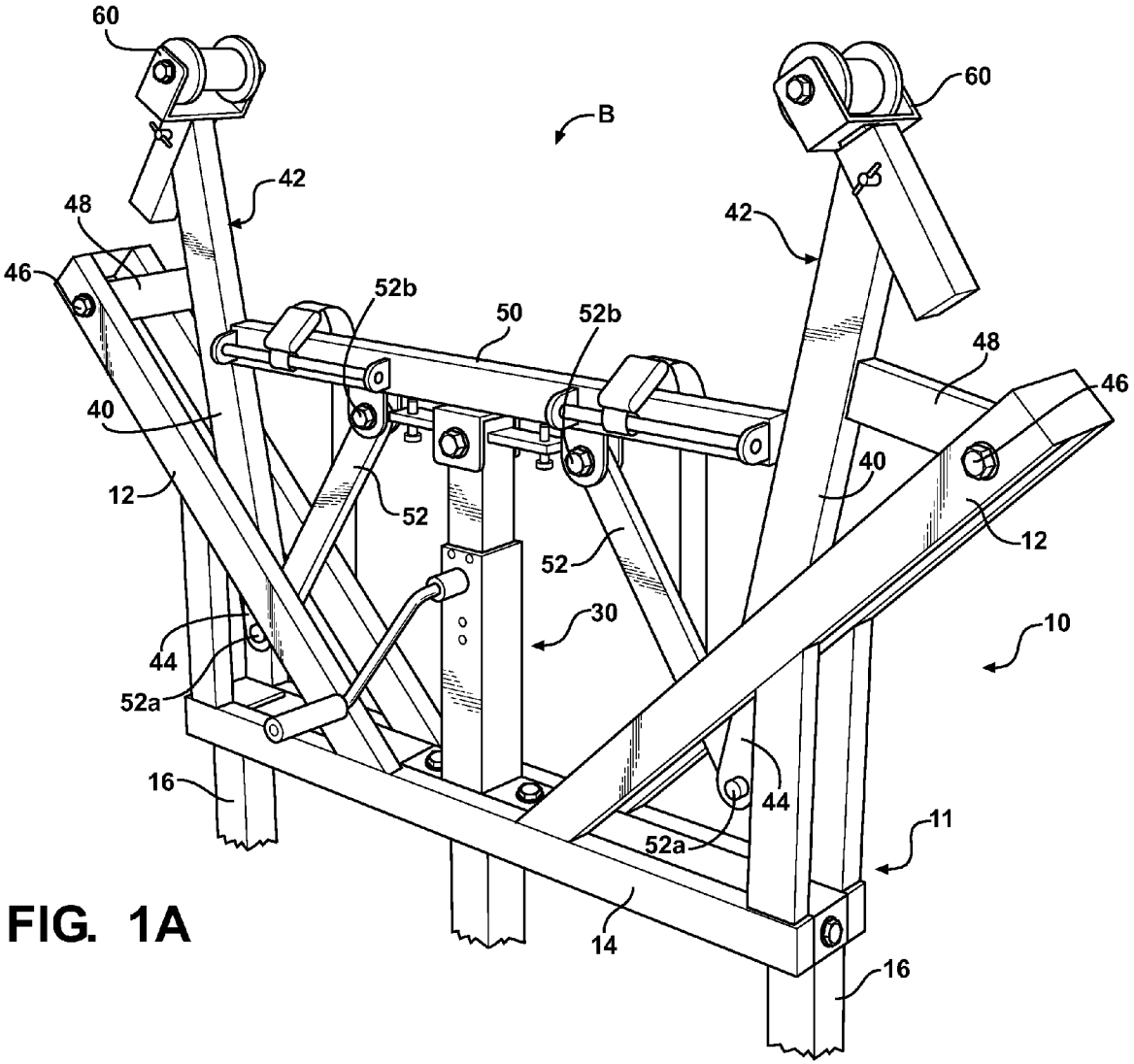
FIG. 1A is a perspective view of the bow press of FIG. 1.

A press drive in the form of a screw jack 30 is secured to the frame, for example secured as shown to the crossbar 14 and optionally to one or more additional crossbars (FIG. 1A) connecting the legs. Although drive 30 is illustrated as mounted on the frame of the bow press 10, it will be understood that a suitably secured drive could be located adjacent the frame and used to operate the press, provided the frame is secured to remain immobile against the force of the drive during operation.

The illustrated frame members are formed from metal such as steel or aluminum, although other materials could be used singly or in different combinations, and are joined into a strong, rigid framework using known connections such as welding, structural adhesives, and/or mechanical fasteners.

Frame 11 and drive 30 support and move a pair of bow-pressing lever arms 40 toward and away from a bow-pressing location defined between them, illustrated schematically at B. Lever arms 40 include upper limb-pressing ends 42 and lower drive ends 44. Lever arms 40 rotate on fixed fulcrum points 46, in the illustrated embodiments a pair of smooth axles or pins or similar pivot-enabling structures located and secured on the frame, for example between the split arms of V-bars 12 as illustrated. Lever arms 40 are spaced inwardly from fulcrum points 46 toward bow-receiving location B by fulcrum-extending arms 48 secured rotatably to fulcrum points 46 at their outer ends and fixed at their inner ends to lever arms 40 between the lever arms' upper and lower ends. The resulting angle of lever arms 40 in the illustrated bow-receiving position of FIG. 1 is an acute angle relative to V-bars 12 and to a vertical axis y running through bow-receiving location B.

It will be understood that throughout this description, the bow press 10 will be assumed to be upright, and any directional terms used (up, down, right, left, vertical, horizontal, etc.) are based on this illustrated orientation for convenience. The bow press 10 may, however, be mounted in other orientations, for example rotated 90-degrees from the upright position shown with a bow placed vertically between lever arms 40. It will also be understood that where the fulcrum points 46 are referred to as "fixed", this means that they do not move during the pressing operation, and does not preclude fulcrum points whose pressing positions can be adjusted on the frame prior to the pressing operation.

Lower drive ends 44 of the lever arms 40 are operatively coupled to drive 30 through pivot arms 52 and a horizontal (transverse) pulling bar 50. Pivot arms 52 are pivotally connected at 52*a* to the lower drive ends 44, and pivotally connected at 52*b* to horizontal pulling bar 50 driven by drive jack 30. The lower ends 44 of the lever arms and their pivoting joints at 52*a* with pivot arms 52 are aligned with frame V-bars 12 so that they can pass freely therethrough if necessary. For this purpose the frame V-bars 12 are each formed from a pair of spaced bar members with sufficient space between them to allow the lever arms to move in and out between them as shown in hidden lines.

Figure 2:
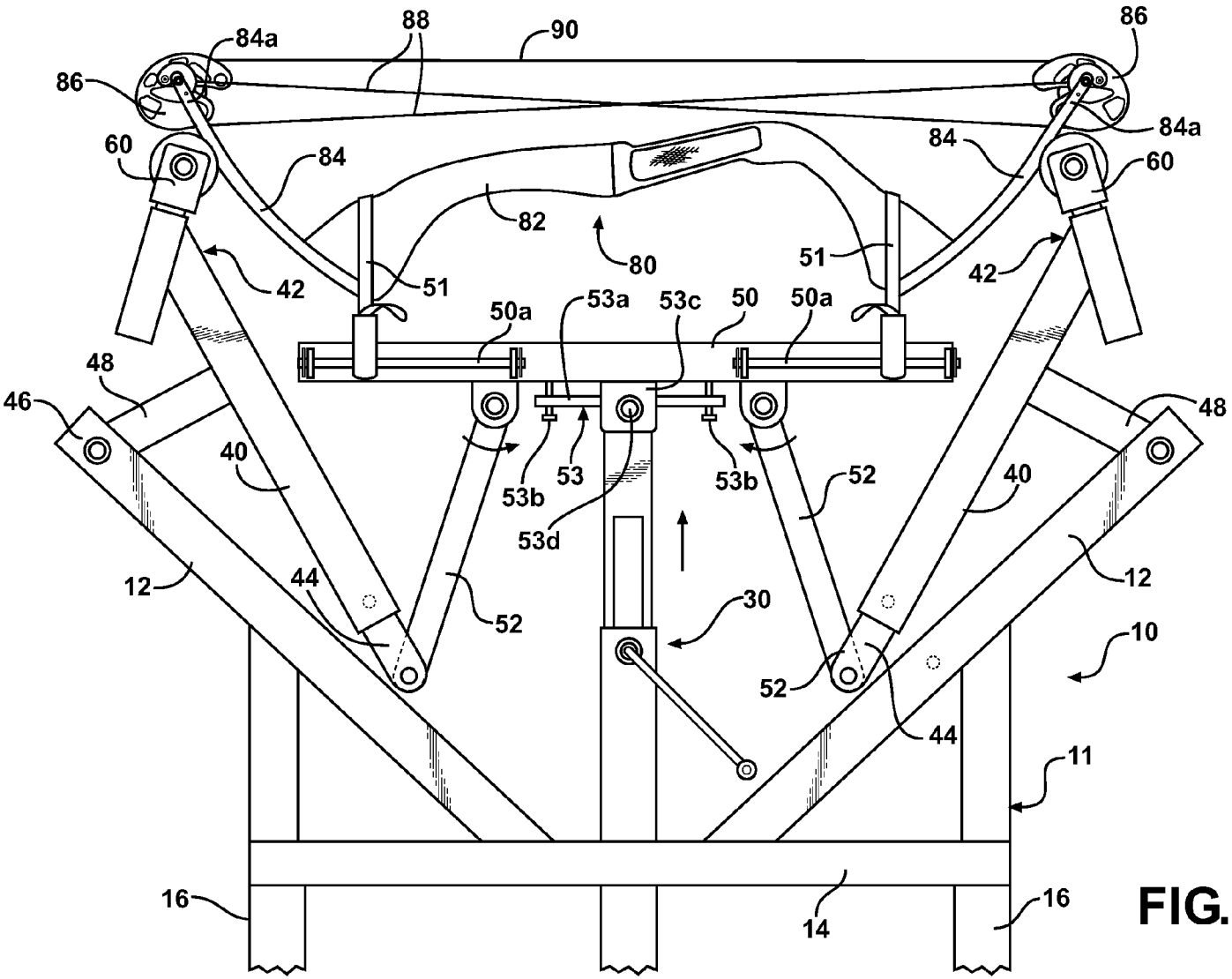
FIG. 2 is similar to FIG. 1, with a bow inserted in the bow press prior to pressing.

Referring next to FIG. 2, a bow 80 is shown secured between the upper limb-pressing ends 42 of lever arms 40 in the bow-receiving location B. Bow 80 is a compound bow having a known combination of riser 82, limbs 84, cams 86, cables 88, and bowstring 90. The illustrated bow is exemplary, and it is believed that the bow press 10 is capable of pressing virtually any make or model or style of compound bow. It will be understood that various features of such bows have been omitted for brevity, and as not being necessary to an understanding of the claimed subject matter. It will also be understood that although the bow press 10 is primarily intended and especially useful for pressing the short, stiff limbs of various compound bows, it may also be used to press crossbows and other styles of non-compound bow, if desired.

The upper ends 42 of lever arms 40 are described herein as "limb-pressing ends". It should be understood that "upper" is intended as a relative term, and is not limited to the terminal or free ends of the lever arms 40. It should also be understood that "limb-pressing ends" should include not only a direct contact between arms 40 and the bow 80, but also any intermediate limb-contacting devices such as 60 secured to the upper ends of lever arms 40.

Drive 30 provides infinite adjustment to lever arms 40 within their range of motion toward and away from the bow-pressing location B, and accordingly allows the initial bow-receiving position of the upper ends 42 of arms 40 (or of contact devices 60) to be adjusted to receive the bow 80 in a secure but uncompressed initial fit, as shown in FIG. 2, so that the bow remains in place between lever arms 40. Depending on the shape of the limb-contacting surface or device on the upper ends 42 of lever arms 40, the bow is secured at or near the ends 84*a* of its limbs 84, adjacent cams 86. The exact location where the bow is best secured will be a matter of ordinary skill in the art, and/or provided by the bow manufacturer, and may vary. In general, however, the closer to the cams, the better.

FIG. 2 also shows the use of riser pulling straps 51 securing in sliding adjustable fashion to rods 50*a* on pulling bar 50 on either side of drive 30. Straps 51 can be adjustably secured and tightened around the bow's riser 82 to apply a balanced pulling force to the bow 80 as drive 30 is operated to press the bow's limbs 84 via lever arms 40. Straps 51 also ensure that bow 80 remains in position in the bow-pressing location between lever arms 40 both before and during the limb-pressing operation. It will be understood that straps 51 could take other forms of connector for securing the pulling bar to riser 82, for example cables, rigid members, clamps, and others that will be understood by those skilled in the art. There could be also more than two straps or connectors 51, or a single balanced connection to the riser.

Pulling bar 50 is also illustrated with a leveling structure 53 and a pivoting connection to the upper end of the telescoping portion of the jack drive 30. In the illustrated embodiment the pivoting connection is via a pair of tongues 53*c* secured with a pivot 53*d* to the upper end of the telescoping inner tube of the drive 30. Leveling adjustments can be made via flanges 53*a* supporting two leveling contacts 53*b* (for example threaded bolts) adjustable against the pulling bar to level the pulling bar relative to bow 80.

Pulling bar 50 is secured in balanced fashion to a reciprocating drive portion of screw jack drive 30, to be moved up and down in linear fashion relative to the frame and a bow 80 in the bow-pressing location. As drive 30 moves bar upwardly, lever arms 40 and their upper limb-contacting ends pivot outwardly to make room for the insertion of a bow 80. Once the bow is secured in the bow-pressing location with its limbs 84 in contact with limb-pressing ends 42 (or with limb-contacting devices 60), and pulling bar 50 is secured to the bow's riser 82 with straps 5, drive 30 can be operated to pull bar 50 downwardly, which then acts through pivot arms 52 to scissor the lever arms 40 inwardly relative to the frame and bow and thus press the ends of limbs 84 inwardly to relax cable tension.

Figure 3:
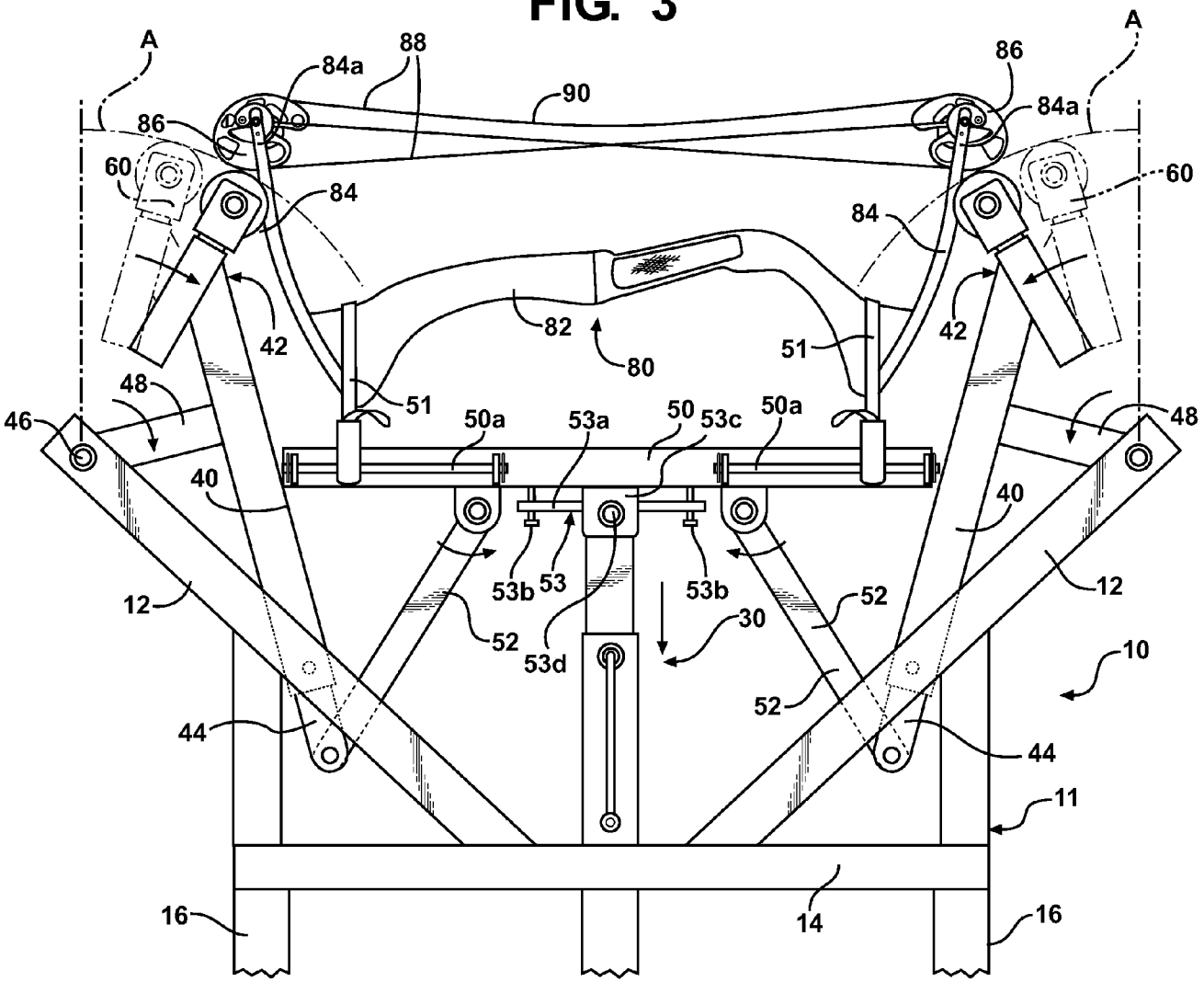
FIG. 3 is similar to FIG. 2, but with the press operated such that the bow limbs have been pressed inwardly to relax tension on the cables, and further schematically illustrating the arc through which the limb-pressing ends of the bow press lever arms move during the pressing operation.

As best shown in FIG. 3, the initial starting positions of the limb-contacting portions of lever arms 40 is at the top of the arc A about which they are constrained to move relative to their fixed fulcrum points 46. This starting position is a result of the outward spacing of fulcrum points 46 from their lever arms 40 (alternately described as the inward spacing of the lever arms 40 from the frame-mounted fulcrum points 46) at a point below the level of the limb-contacting upper ends 42 of the lever arms, via the fulcrum-extending arms 48. Alternately, the limb-contacting portions of the lever arms could have an initial starting position at a point inwardly and downwardly along arc A relative to the top of the arc. Whether at the top of the arc or inwardly and downwardly from the top of the arc, the limb-contacting portions are thus prevented from moving upwardly along bow limbs 84 toward cams 86 during a pressing operation.

Figure 4:
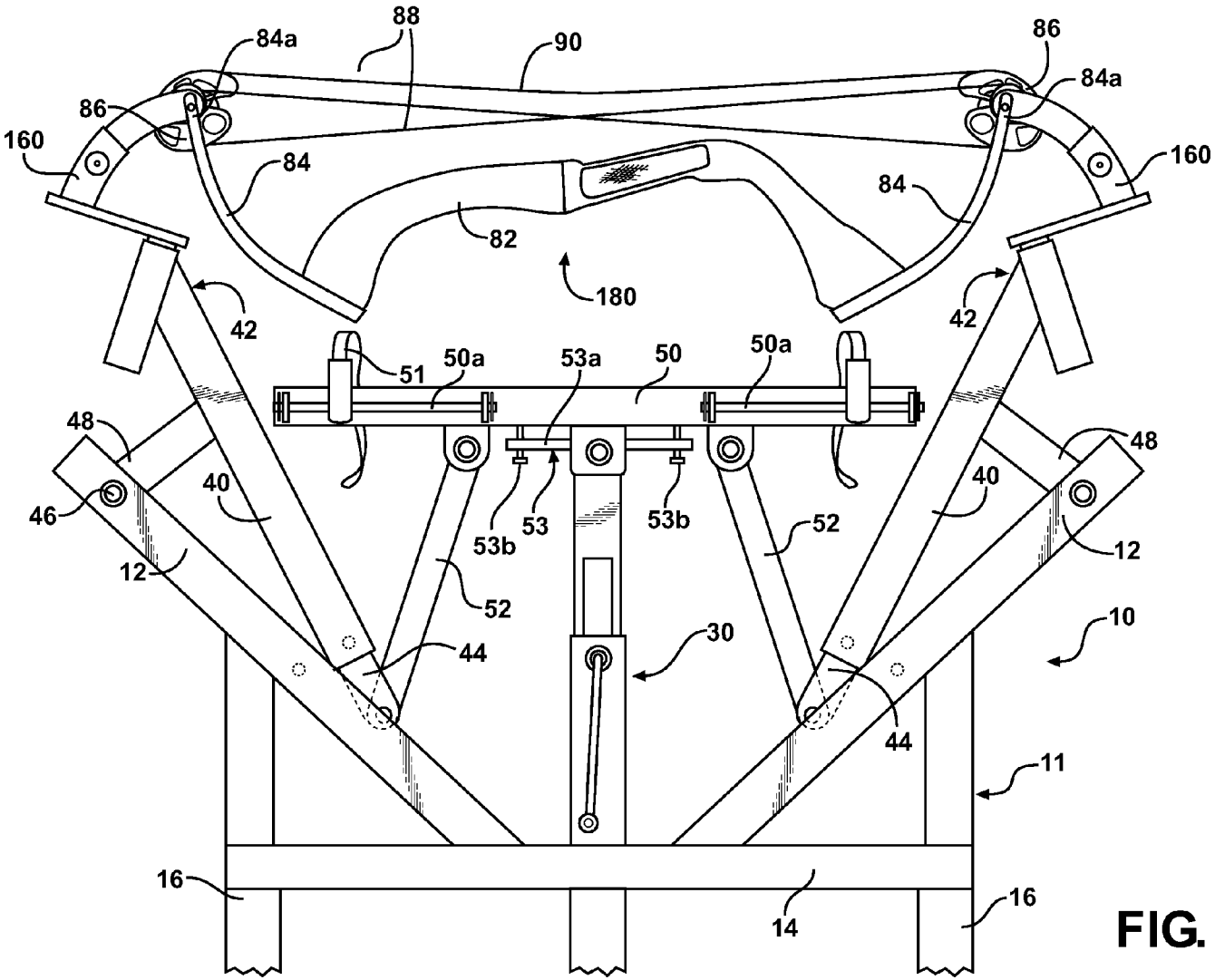
FIG. 4 shows the press of FIG. 1 modified with a different set of bow limb contact devices and pressing a different style of compound bow.
Figure 5:
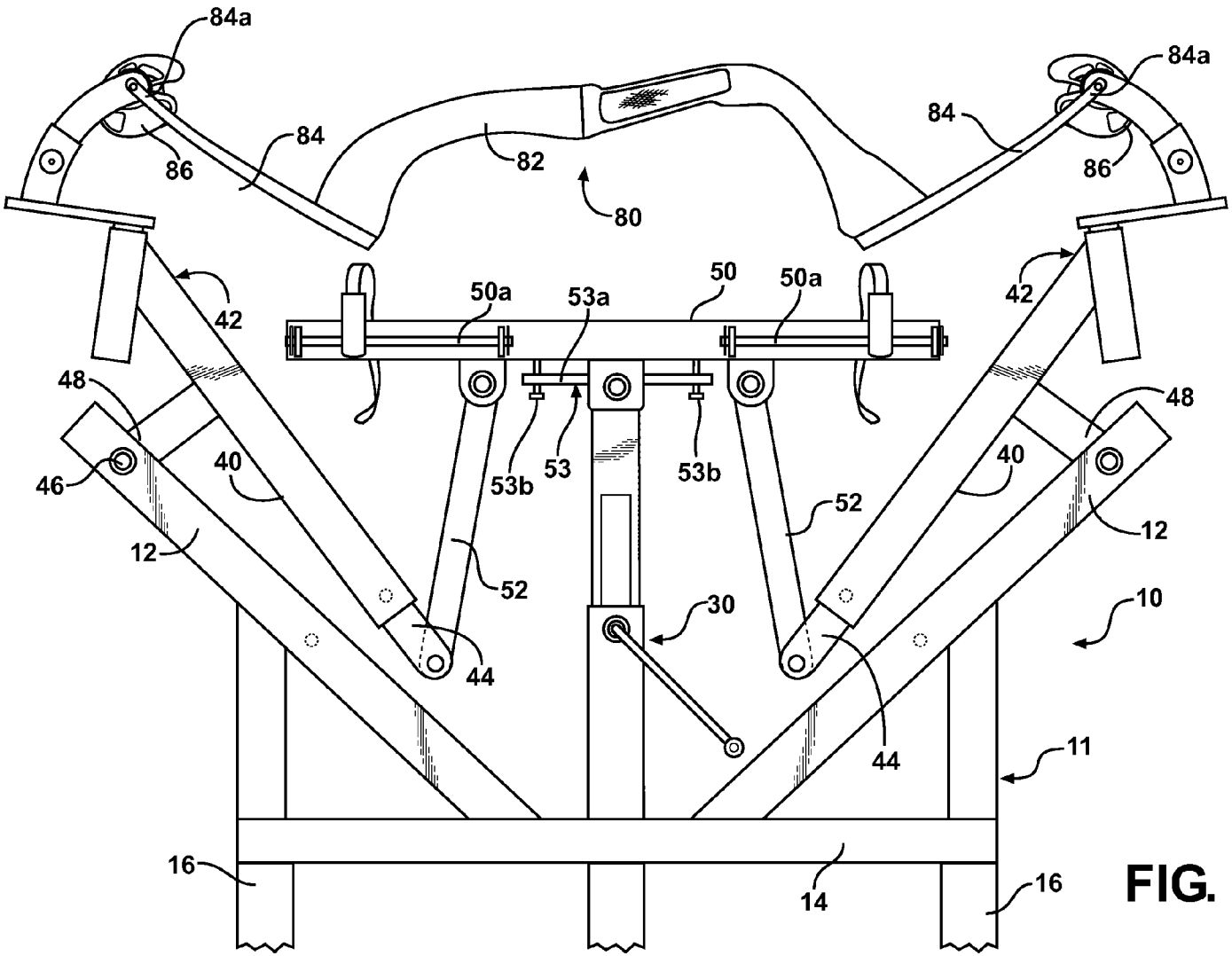
FIG. 5 shows the press and bow of FIG. 4 after the bow has been pressed, the cables and string removed, and the press re-opened to allow the bow limbs to fully relax.

FIGS. 4 and 5 show the same bow press 10 modified with different limb-contacting devices 160 to press a different style of bow 180. Otherwise, the structure and operation of press 10 are the same in FIGS. 4 and 5 as in FIGS. 1 through 3. It will be understood that the two illustrated examples of bow, and the two illustrated examples of limb-contacting devices are but examples of many possible bows and devices that can be pressed and used in various combinations with the claimed bow press.

Figure 6:
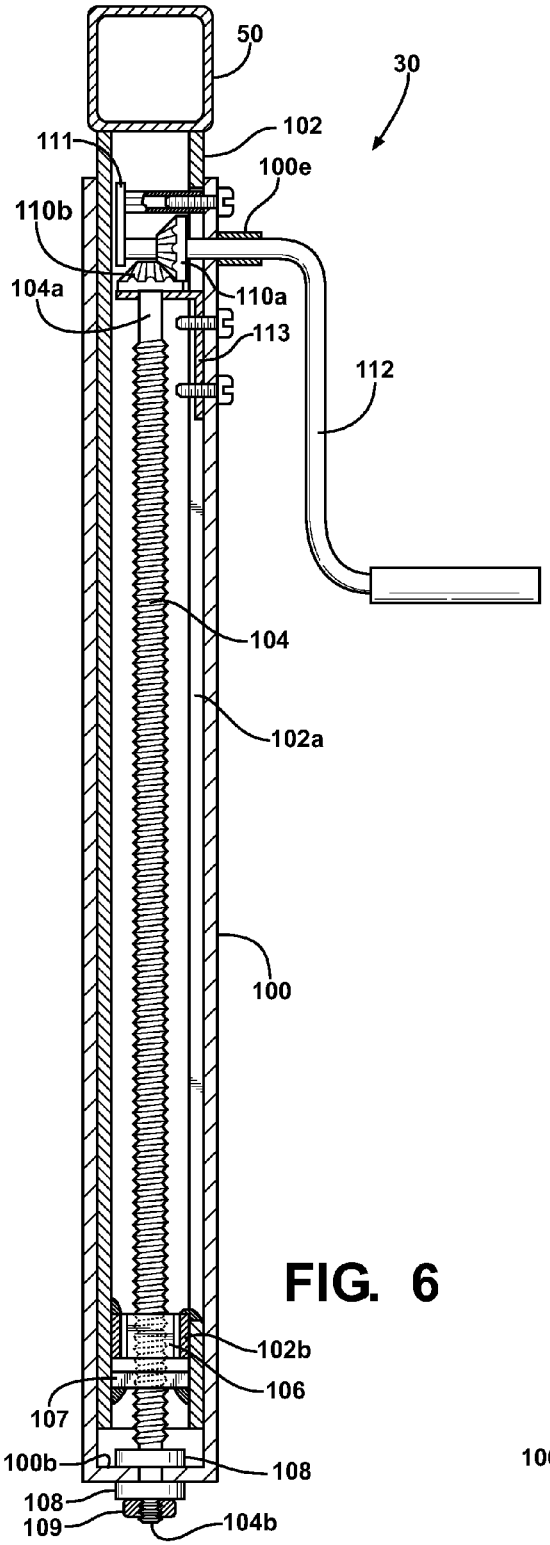
FIG. 6 is a front elevation view of the screw jack mechanism illustrated in the press of FIGS. 1-5, partially cut away to show internal mechanisms.
Figure 7:
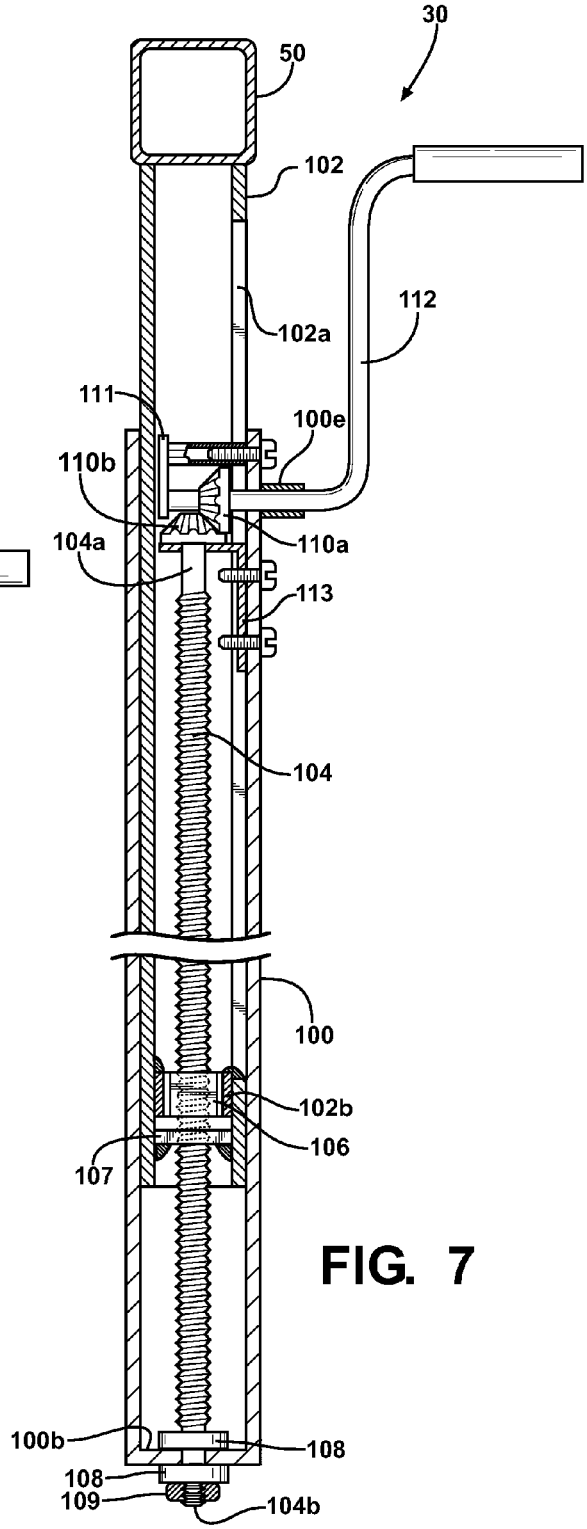
FIG. 7 is similar to FIG. 6, but showing the jack extended.
Figure 8:
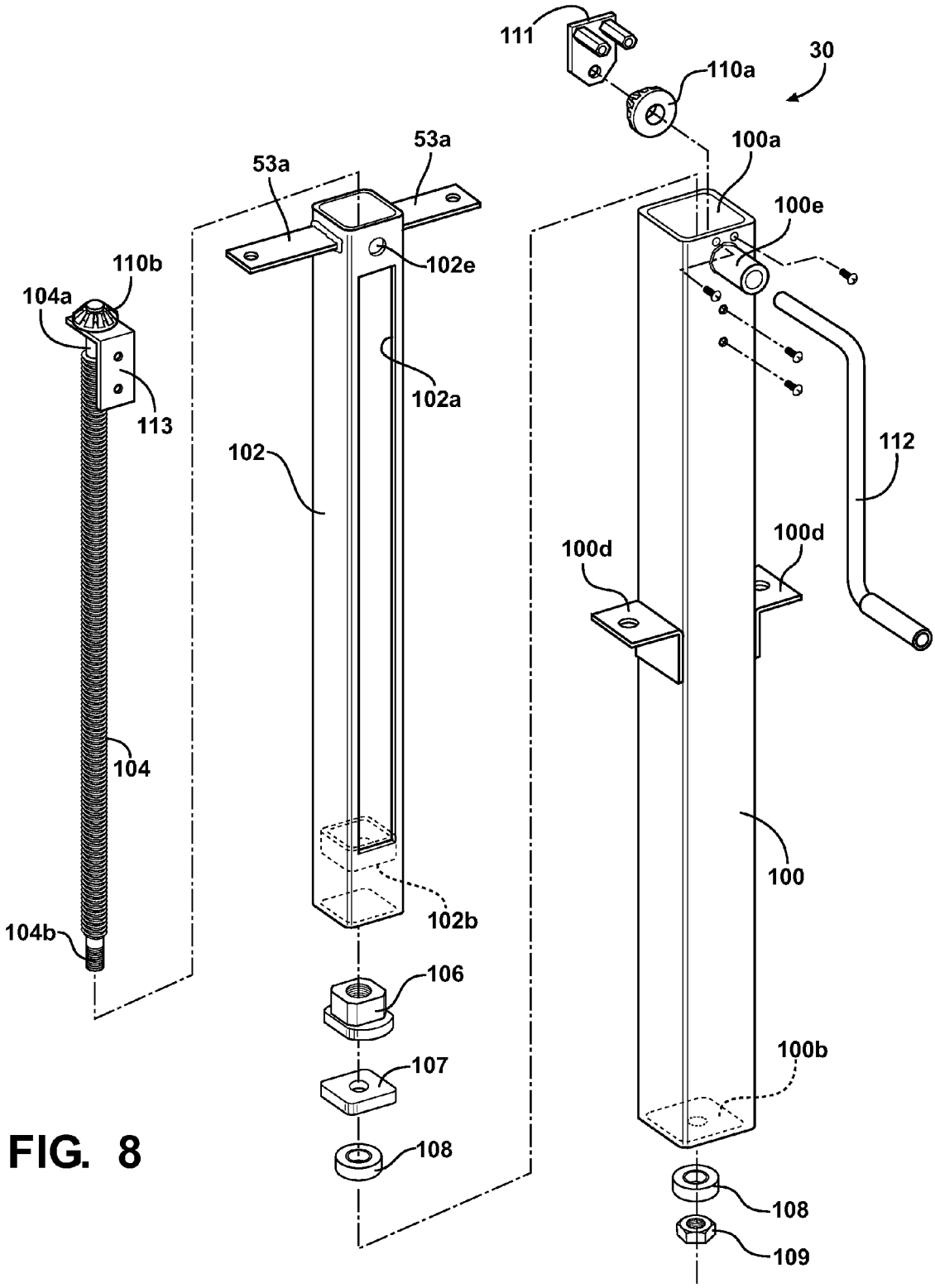
FIG. 8 is an exploded assembly view of the screw jack of FIG. 6.

Referring next to FIGS. 6 through 8, a particular and preferred form of drive 30 is illustrated and described in more detail. Illustrated drive 30 is a center-wind telescopic screw jack which I have invented, both powerful and compact enough to be self-supported on the frame of bow press 10 and to press any compound bow of which I am aware, no matter how stiff the limbs or where on the limbs the pressing contact is made. Jack 30 comprises an outer base tube 100, an inner drive tube 102 mounted for sliding movement in outer tube 100, a threaded screw drive shaft 104 mounted in outer tube 100 and in operative driving engagement with inner tube 102, and a crank 112 or other rotation-imparting device (including but not limited to a motor) for operating drive shaft 104 to drive inner tube up and down relative to outer tube 100.

Inner tube 102 is operatively coupled to pulling bar 50 on the bow press 10, for example as illustrated via hole 102*e* and a pair of leveling flanges 53*a* with screws or bolts or other adjustable fasteners adjustably securing the flanges to the pulling bar. Inner tube 102 is operatively connected to, and driven by, threaded shaft 104 via a drive nut assembly 106 trapped in non-rotatable fashion in a pocket 102*b* in the lower end of tube 102, for example by a shaped fit between the lower flange of the nut and the pocket, and by a short inner sleeve or inwardly bent tabs 102*b* engaging the upper surface of the nut's lower flange. The trapped nut assembly 106 is threadably fitted to shaft 104, so that when the shaft is turned, the nut (and the inner tube 102 to which the nut is operatively connected) is forced to move up and down inside outer tube 100, depending on the direction of rotation of the drive shaft 104.

Drive shaft 104 is rotatably secured at its lower end to the lower end 100*b* of outer tube 100 on a dual thrust bearing assembly 108, 109. The upper end of drive shaft 104 is rotatably secured on a bracket 113, with a first bevel gear 110*b* secured to the upper end of the drive shaft on top of the bracket to rotate with the drive shaft. A second, perpendicular bevel gear 110*a* is mounted on a second bracket assembly 111 to be coupled to and driven by a hand crank or other power mechanism 112. Rotating crank 112 causes gear 110*a* to rotate, in turn rotating gear 110*b* and drive shaft 104. In the illustrated embodiment, crank 112 enters the outer tube via collar 100*e* to engage bevel gear 110*a* and power the gear assembly.

Inner tube 102 is formed with a longitudinal slot 102*a* in its sidewall, the slot positioned to ride over the bevel gear assembly 110*a*, 110*b*, 111, 113, which is positioned interiorly of the inner tube.

In the preceding description, various aspects and examples and configurations of making and using the invention as defined by the claimed subject matter have been described, for purposes of explanation, to provide a thorough understanding of claimed subject matter, and to enable those skilled in the art to make and use claimed subject matter. However, these are merely example illustrations and descriptions of inventive concepts wherein other illustrations may apply as well, and the scope of claimed subject matter is not limited in these respects. It should be apparent to one skilled in the art having the benefit of this disclosure that claimed subject matter may be practiced without being limited to the specific details of the disclosure. In other instances, well-known features were omitted and/or simplified so as not to obscure claimed subject matter. While certain features have been illustrated and/or described herein, many modifications, substitutions, changes and/or equivalents will now occur to those skilled in the art. It is, therefore, to be understood that the appended claims are intended to cover all such modifications and/or changes as fall within the true spirit of invention as reflected by the preceding disclosure. It should further be understood that to the extent the term "invention" is used in the written specification, it is not to be construed as a limiting term as to number or type of claimed or disclosed inventions or the scope of any such invention, and does not exclude discoveries or designs; rather, it is a term which has long been conveniently and widely used to describe new and useful improvements in technology.

What is claimed:

1. A bow press for pressing the limbs of an archery bow to relax and permit servicing of string-tensioning components, comprising:

a frame;

a pair of coplanar lever arms mounted on the frame and defining a bow-receiving location therebetween, with a first bow press axis defined by a distance between the upper limb-pressing ends of the lever arms and a second bow press axis defined orthogonally to the first bow press axis through a center of the bow-pressing location;

each of the lever arms comprising a lower drive end farther from the first bow press axis and pivotable on a lower drive pivot spaced from and opposite a lower drive pivot of the other lower drive end with respect to the second bow press axis, and an upper limb-pressing end nearer to the first bow press axis, the upper limb-pressing end adapted to engage a limb of a bow, each of the lever arms mounted for rotational movement on a fixed fulcrum point on the frame spaced from and opposite a fixed fulcrum point of the other lever arm with respect to the second bow press axis, each fixed fulcrum point operatively connected to its associated lever arm between the upper limb-pressing end and the lower drive end;

a drive operatively connected to the lower drive ends to simultaneously rotate the upper limb-pressing ends of the lever arms on the fixed fulcrum points toward and away from the bow-receiving location; wherein the upper limb-pressing end of each lever arm is spaced inwardly relative to the bow-receiving location from its fixed fulcrum point by a fulcrum-extending arm rotatably connected to the fixed fulcrum point and non-rotatably connected to the lever arm, and wherein the fixed fulcrum point is located outwardly of the upper limb-pressing end of the associated lever arm relative to the bow-receiving location and below the upper limb-pressing end of the associated lever arm relative to the first bow press axis.

2. The bow press of claim 1, wherein the drive is operatively connected to each lower drive end with a pivot connection through a pivot arm.

3. The bow press of claim 2, wherein the drive comprises a reciprocating member including a bow-pulling member located between the lever arms and below the bow-receiving location relative to the first bow press axis, the bow-pulling member located below the bow-receiving location relative to the first bow press axis and adapted to be secured to a bow in the bow-receiving location and movable toward and away from the bow-receiving location on the second bow press axis.

4. The bow press of claim 3, wherein the bow-pulling member comprises a pulling bar substantially parallel to the first bow press axis and moveable in a direction parallel to the second bow press axis, the pulling bar pivotally connected to each of the lower drive ends of the lever arms at spaced points and including means for connecting the pulling bar to a riser of a bow in the bow-receiving location.

5. The bow press of claim 4, wherein the reciprocating member is connected to a center portion of the pulling bar, and the spaced points are located on opposite sides of the center portion.

6. The bow press of claim 5, wherein the pulling bar is pivotally connected to each of the lower drive ends of the lever arms by a pivot arm pivotally connected at one end to the pulling bar and pivotally connected at another end to the lower drive end of the lever arm.

7. The bow press of claim 1, wherein the lever arms have a starting position at an acute angle relative to the first bow press axis and to the second bow press axis, with their limb-pressing ends being more widely spaced than their lower drive ends.

8. The bow press of claim 1, wherein the upper limb-pressing ends of the lever arms have a starting position at a top of an arcuate path of travel toward the bow-pressing location, the arcuate path of travel being convex relative to an intersection of the first bow press axis with the second bow press axis in the bow-receiving location, the top of the arcuate path of travel defined by the associated upper limb-pressing end's furthest point of travel from the second bow press axis in the direction of the first bow press axis.

9. The bow press of claim 8, wherein the top of the arcuate path of travel includes a position spaced inwardly toward the bow-pressing location relative to the top of the arcuate path of travel.

10. The bow press of claim 3, wherein the drive comprises a screw jack.

11. The bow press of claim 10, wherein the drive comprises a center-wound screw jack.

12. The bow press of claim 11, wherein the center-wound screw jack comprises a slotted telescopic inner tube.

13. The bow press of claim 1, wherein the drive is supported by the frame.

14. The bow press of claim 10, wherein the screw jack is supported by the frame.

15. The bow press of claim 1, wherein the fixed fulcrum points are located below the limb-pressing ends of their respective lever arms relative to the lower drive ends of the lever arms.

* * * * *